United States Patent [19]

Trowbridge

[11] 4,019,270

[45] Apr. 26, 1977

[54] MITRE FRAME CLAMP

[76] Inventor: Leonard D. Trowbridge, 16200 Woodbridge, Harvey, Ill. 60426

[22] Filed: Mar. 27, 1975

[21] Appl. No.: 562,571

[52] U.S. Cl. ..... 40/155

[51] Int. Cl.[2] ..... G09F 1/12

[58] Field of Search ..... 40/155, 152.1, 152, 40/154, 209; 248/488, 490; 24/19; 85/50 R

[56] References Cited

UNITED STATES PATENTS

| | | | |
|---|---|---|---|
| 135,082 | 1/1873 | Clem | 85/50 R |
| 1,420,268 | 6/1922 | Hodny | 248/488 |
| 1,928,182 | 9/1933 | Mahoney | 85/50 R |
| 2,209,972 | 8/1940 | Horwitt | 40/152.1 |
| 2,368,991 | 2/1945 | Kopp | 40/10 R |
| 3,849,920 | 11/1974 | Trowbridge | 40/155 |

FOREIGN PATENTS OR APPLICATIONS

| | | | |
|---|---|---|---|
| 576 | 2/1879 | United Kingdom | 40/155 |

*Primary Examiner*—Louis G. Mancene
*Assistant Examiner*—Wenceslao J. Contreras
*Attorney, Agent, or Firm*—Sabin C. Bronson

[57] ABSTRACT

A picture frame clamp having four corner brackets for holding the respective corners at a right angular relationship. The four corner brackets are four diagonally extending strap lengths which are connected adjacent the intersecting ends thereof by an adjustment screw to firmly clamp the corners together in a right angular relationship.

The straps are connected to the corners so as to be capable of varying the length thereof to the clamp at the intersection thereby to permit the clamp to be adaptable for use for different picture frames.

5 Claims, 2 Drawing Figures

MITRE FRAME CLAMP

This invention is an improvement over the invention illustrated and described in my recently issued U.S. Pat. No. 3,849,920, granted on Nov. 26, 1974.

BACKGROUND AND SUMMARY OF THE INVENTION

The present invention relates to clamps or fixtures for clamping and assembling a picture frame in a manner such that the corners are held in a true right angular relationship.

Briefly the picture frame fixture of the present invention comprises generally four brackets each having right angular walls which engage the right angular walls forming the corners of the picture frame. A length of strap extends diagonally from each of the corner brackets and is connected thereto. Each of the straps is adjustable relative to its respective bracket so as to permit the clamp to be used for different size picture frames. An adjustment screw is connected to the inner ends of each of the strap lengths so as to tightly and quickly clamp the corners.

DESCRIPTION OF THE PREFERRED EMBODIMENTS

Figure 1:
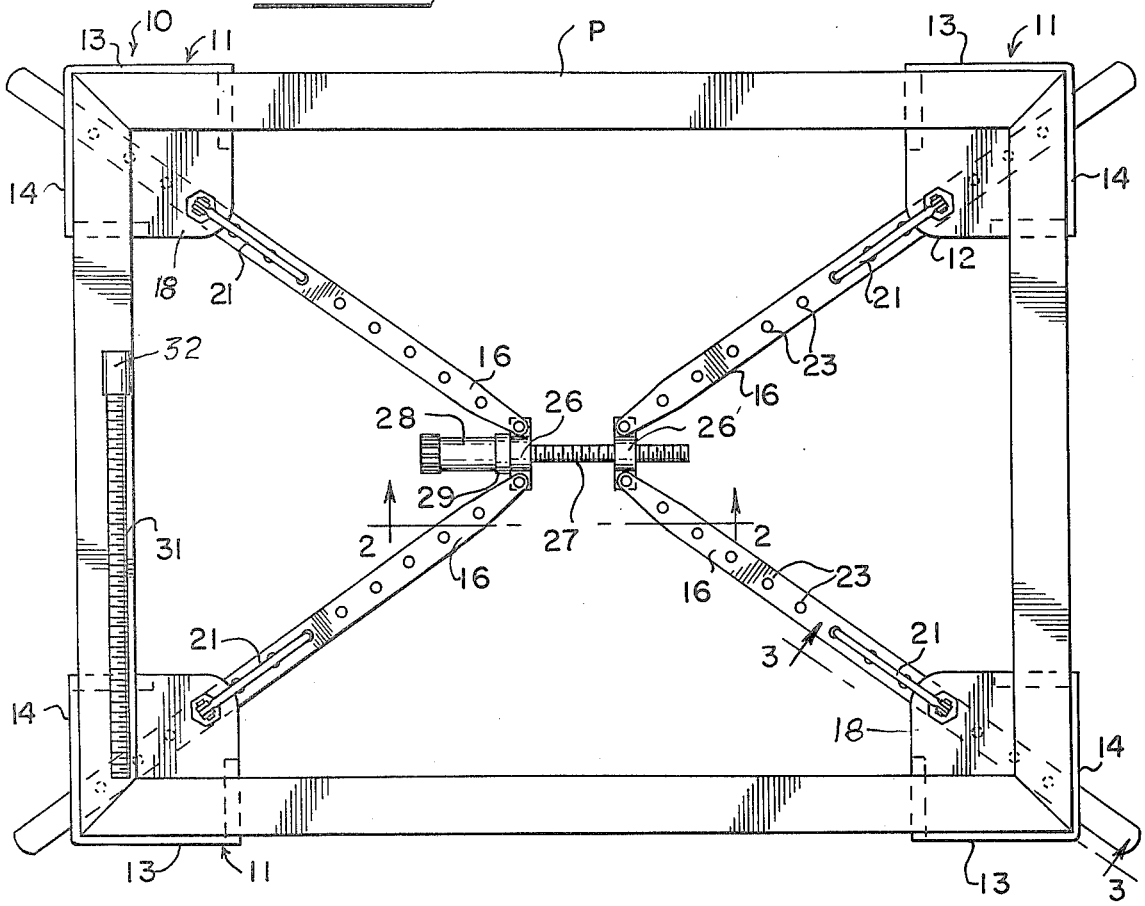
FIG. 1 is a top plan view of a picture frame clamp embodying the structure of the present invention.
Figure 3:
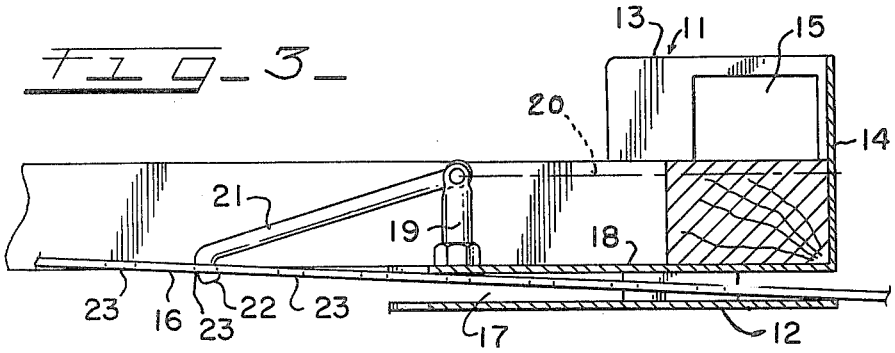
FIG. 3 is a cross sectional view taken generally along the lines 3—3 of FIG. 1.
Figure 2:
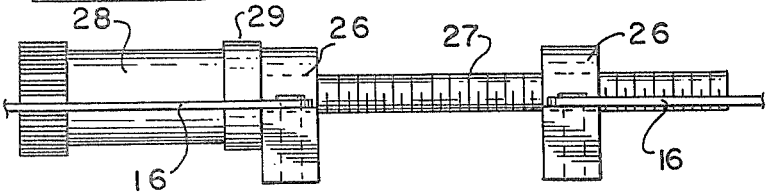
FIG. 2 is a cross sectional view taken generally along the lines 2—2 of FIG. 1.

Referring now to FIGS. 1–3 there is shown one embodiment of a picture frame clamp 10 incorporating the structure of the present invention.

The clamp 10 includes four corner brackets 11 of identical construction.

The brackets 11 each include a generally rectangular base 12 along two of the outer sides of which projects a pair of walls 13 and 14 which are disposed at right angles. The walls 13 and 14 serve to maintain the corners of a picture frame P in right angular relationship as shown. A slot or opening 15 is formed in each of the walls 13 and 14 to permit the insertion of nails into the picture frame.

One end of a diagonally extending strap length 16 is disposed in a diagonally extending slot or groove 17. Disposed over the slot 17 and fixed to the base 12 is a plate 18. A pivot stud 19 is suitably fixed to the base 12. A hook 21 is pivotally connected to the stud 19 and a hooked end 22 thereof is received in one of a plurality of lengthwise spaced openings 23 provided in the strap length 16. Upon lifting of the hook 21 about the pivot stud 19 the hooked end 22 is disengaged from the opening 23 so that the strap length is freely slidable within the groove 17. This permits the length of the strap length 16 to be varied so that different size picture frames may be assembled.

In the embodiment shown the four strap lengths 16 are arranged in two pairs, of which each pair is connected at the inner ends by a block 26. Extending through each of the blocks 26 and 26' is an adjusting screw 27. The adjusting screw 27 passes through an unthreaded opening in the block 26 and into and through a threaded opening in block 26'. A thumb grip 28 is provided on one end of the screw 27. Between the thumb grip 28 and the block 26 is a thrust bearing 29. Turning of the adjustment screw by manually turning the thumb grip 28 causes the blocks 26 and 26' to be drawn toward each other pulling equally on the strap length 16. The addition of the thrust bearing 29 on the adjusting screw is what makes it possible to manually operate or rotate the thumb grip 28 until the corners 13 are pulled together tightly about the frame. The thrust bearing removes the friction that would result, if the end of the thumb grip 28 turned against the side of the block 26. Thus the thumb grip 28 turns easily even when the corners are tight against the frame. Because the pivot studs 19 are mounted on the base plates 12 of the brackets and the hooks 21 are connected to the upper ends of the studs 19 the pulling force on the brackets is on the dotted line 20 (FIG. 3) which is substantially midway of the height of the brackets. In this way there is no tendency of the brackets to tip when force is applied thereto by turning manually the thumb grip 28.

Turning of the adjustment screw by manually turning the thumb grip 28 causes the corner brackets to be moved inwardly or outwardly relative to each other so that the picture frame P may be released or removed from the clamp 10. When the adjusting screw is turned so that the corner brackets 11 move inwardly relative to each other the corners of the picture frame are firmly gripped. If the frame is to be glued together, the glue is applied to the mitered ends of the frame pieces and then the adjusting screw is turned so that the brackets firmly grip the frame and it is allowed to set until the glue hardens. If the frame is to be nailed together, nails are applied through the openings 15 when the clamp firmly holds the frame pieces together.

This frame clamp is adjustable as to size. When it is desired to adjust the clamp for larger frames, the thumb grip 28 is operated to release the tension on the straps 16 until the hooked ends 22 of the hooks 21 may be removed from enegagement therewith. The corner brackets may then be moved farther apart so as to hold a larger frame for example, and then the hooks 22 may be placed in a hole 23 fartheraway from the blocks 26–26'. The adjustment screw 27 may not be long enough to enter the block 26' in which event the bolt extension 31 may be applied on the end of bolt 27 by use of the connecting nipple 32.

It is thus apparent that I have devised an improved adjustable frame clamp and have described the same with the requisite particularity so that those familiar with this art may readily construct and use the same.

What is claimed is:

1. A picture frame clamp comprising four corner brackets having wall means, for engaging the four corners of a picture frame so as to maintain the corners at right angles relative to each other, diagonally extending strap means attached to each of said corner brackets, space blocks connecting said straps at one end to form two pairs of strap means, an adjusting screw extending through said blocks to move said corner brackets inwardly and outwardly relative to each other, a thumb piece fixed to one end of said adjusting screw, and a thrust-bearing between said thumb piece and an adjacent block.

2. The invention as defined in claim 1 wherein said adjusting screw includes an extension screw threaded to the opposite end from said thumb screw.

3. The invention as defined in claim 1 wherein one of said blocks is provided with an unthreaded opening through which the adjusting screw extends and the other of said blocks is provided with a threaded opening through which the adjusting screw extends.

4. The invention as defined in claim 1 wherein pivot studs are fixed to each bracket base, hooks are pivotally connected at one end to the top of said studs, the other end of said hooks being hooked into an opening in said strap means.

5. The invention as defined in claim 1 wherein said wall means are each provided with an opening through which fastening means may be applied to said picture frame.

* * * * *